US007656367B2

(12) United States Patent
Ito

(10) Patent No.: US 7,656,367 B2
(45) Date of Patent: Feb. 2, 2010

(54) PLASMA DISPLAY DEVICE AND DRIVING METHOD THEREOF

(75) Inventor: Kazuhiro Ito, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 683 days.

(21) Appl. No.: 11/258,730

(22) Filed: Oct. 25, 2005

(65) Prior Publication Data

US 2006/0103597 A1 May 18, 2006

(30) Foreign Application Priority Data

Nov. 15, 2004 (KR) ..... 10-2004-0093020
Aug. 31, 2005 (KR) ..... 10-2005-0080780

(51) Int. Cl.
*G09G 3/28* (2006.01)

(52) U.S. Cl. ..... 345/60; 345/63

(58) Field of Classification Search ..... 345/60–72
See application file for complete search history.

(56) References Cited

U.S. PATENT DOCUMENTS

| | | | | |
|---|---|---|---|---|
| 5,745,086 | A | 4/1998 | Weber | |
| 6,362,800 | B1 | 3/2002 | Moon | |
| 2002/0167381 | A1 | 11/2002 | Ide et al. | |
| 2004/0212563 | A1 * | 10/2004 | Kang et al. | 345/60 |
| 2005/0122285 | A1 * | 6/2005 | Kang et al. | 345/60 |
| 2005/0140588 | A1 | 6/2005 | Lee et al. | |

FOREIGN PATENT DOCUMENTS

| | | | |
|---|---|---|---|
| CN | 1243996 | A | 2/2000 |
| CN | 1304127 | A | 7/2001 |
| CN | 1409286 | A | 4/2003 |
| EP | 1 065 650 | | 1/2001 |
| JP | 07-191627 | | 7/1995 |
| JP | 08-044315 | | 2/1996 |
| JP | 08-320667 | | 12/1996 |
| JP | 11-327503 | | 11/1999 |
| JP | 2000-347619 | | 12/2000 |
| JP | 2001-035395 | | 2/2001 |
| JP | 2001-075526 | | 3/2001 |

(Continued)

OTHER PUBLICATIONS

European Search Report, dated Dec. 27, 2005, for Application No. 05110001.4, in the name of Samsung SDI Co., Ltd.
Korean Patent Abstracts for Publication No. 1020030027173 A; Date of publication of application Apr. 7, 2003, in the name of Seong Won Ji.

(Continued)

*Primary Examiner*—Kevin M Nguyen
*Assistant Examiner*—Cory A Almeida
(74) *Attorney, Agent, or Firm*—Christie, Parker & Hale, LLP

(57) ABSTRACT

A driving waveform is applied to a scan electrode while a sustain electrode is biased at a ground voltage such that a driving board for driving the sustain electrode may not be needed. In addition, when grouping a plurality of scan electrodes into a plurality of groups and representing grayscale values using a frame-subfield method, a sustain discharge may be stably generated during a sustain period by reducing a time gap between address and sustain periods. When a sustain pulse is applied during a sustain period between two adjacent address periods, the last voltage is set to be a low level voltage.

19 Claims, 9 Drawing Sheets

FOREIGN PATENT DOCUMENTS

| | | |
|---|---|---|
| JP | 2001-184022 | 7/2001 |
| JP | 2001-350446 | 12/2001 |
| JP | 2002-062844 | 2/2002 |
| JP | 2003-338249 | 11/2003 |
| JP | 2004-177933 | 6/2004 |
| JP | 2004-184968 | 7/2004 |
| KR | 2003-0027173 | 4/2003 |
| KR | 10-2004-0046264 | 6/2004 |

OTHER PUBLICATIONS

Patent Abstracts of Japan for Publication No. 2001-184022; Date of publication of application Jul. 6, 2001, in the name of Shiozaki Hironari et al.

Korean Patent Abstracts, Publication No. 1020040046264 A, dated Jun. 5, 2004, in the name of Seung Hun Chae et al.

* cited by examiner

FIG.6

| Subfield No. | 1 | 2 | 3 | 4 | 5 | 6 | 7 | 8 |
|---|---|---|---|---|---|---|---|---|
| Electrode \ Grayscale | 1 | 2 | 4 | 8 | 16 | 32 | 64 | 128 |
| G1 | $Y_{11}$ $Y_{12}$ ••• | | | | | | | |
| G2 | $Y_{21}$ $Y_{22}$ ••• | | | | | | | |
| ••• | ••• | | | | | | | |
| Gn | $Y_{n1}$ $Y_{n2}$ ••• | | | | | | | |

PLASMA DISPLAY DEVICE AND DRIVING METHOD THEREOF

CROSS-REFERENCE TO RELATED APPLICATION

This application claims priority to and the benefit of Korean Patent Application Nos. 10-2004-0093020 filed on Nov. 15, 2004, and 10-2005-0080780 filed on Aug. 31, 2005, both applications filed in the Korean Intellectual Property Office, the entire contents of which are incorporated herein by reference.

BACKGROUND OF THE INVENTION

1. Field of the Invention

The present invention relates to plasma display device and a method for driving the same.

2. Description of the Related Art

A plasma display device is a display device that uses plasma generated by gas discharge to display characters or images. It includes, depending on its size, hundreds of thousands to millions of pixels arranged in a matrix pattern. Such a plasma display panel (PDP) is classified as a direct current (DC) type or an alternating current (AC) type according to its discharge cell structure and the waveform of the driving voltage applied thereto.

The DC PDP has electrodes exposed to a discharge space, and accordingly, it allows a DC to flow through the charge space while a voltage is applied. Therefore, such a DC PDP problematically requires a resistance for limiting the current. On the other hand, the AC PDP has electrodes covered with a dielectric layer that forms a capacitor to limit the current and protects the electrodes from the impact of ions during discharge. Accordingly, the AC PDP has a longer lifetime than the DC PDP.

In general, one frame of the AC PDP is divided into a plurality of subfields, and each subfield includes a reset period, an address period, and a sustain period.

The reset period is for initializing the state of each discharge cell so as to facilitate an address operation on the discharge cell, and the address period is for selecting turn-on/turn-off cells (i.e., cells to be turned on or off) in a panel and accumulating wall charges to the turn-on cells (i.e., addressed cells). The sustain period is for causing a discharge for displaying an image on the addressed cells.

In order to perform the above-noted operations, sustain pulses are alternately applied to the scan electrodes and the sustain electrodes during the sustain period, and the reset waveforms and scan waveforms are applied to the scan electrodes during the reset period and the address period. Therefore, a scan driving board for driving the scan electrodes and a sustain driving board for driving the sustain electrodes are separately needed, and in this case, a problem of mounting the driving boards on a chassis base may exist, and the cost increases because of the separate driving board.

Therefore, for combining the two driving boards into a single combined board, schemes of providing the single board at an end of the scan electrode and extending an end of the sustain electrodes to reach the combined board have been proposed. However, when the two driving boards are combined as such, the impedance component formed at the extended sustain electrodes is increased.

SUMMARY

The embodiments of the invention include a plasma display device and a driving method thereof having the features of removing a driving board that drives a sustain electrode.

In addition, the embodiments of the invention have features including preventing misfiring.

In one exemplary embodiment, a driving method for a plasma display device divides one frame into a plurality of subfields. The plasma display device has a plurality of first electrodes and a plurality of second electrodes, the plurality of the second electrodes being grouped into a plurality of groups including a first group and a second group. According to one embodiment of the invention, the plasma display device includes at least one subfield including a plurality of address periods and a plurality of sustain periods with respective correspondence to the plurality of groups. Turn-on cells are selected from cells of the first and second groups during the address periods of the respective first and second groups. During a first sustain period among the plurality of sustain periods where the first sustain period is provided between the address periods of the first and second groups, a sustain discharge is generated in cells of a plurality of groups including the first group by alternately applying second and third voltages to the plurality of second electrodes while the plurality of first electrodes are biased at a first voltage. The second and third voltages are respectively higher and lower than the first voltage. During a second sustain period provided after the address period of the second group among the plurality of sustain periods, a sustain discharge is generated in cells of a plurality of groups including at least the first and second groups by alternately applying fourth and fifth voltages to the plurality of second electrodes while the plurality of first electrodes are biased at the first voltage. The fourth and fifth voltages are respectively higher and lower than the first voltage.

An exemplary plasma display device according to one embodiment includes a plasma display panel, a driving board, and a chassis base. The plasma display panel has a plurality of first electrodes and a plurality of second electrodes. The driving board applies a driving waveform to the second electrodes such that the plasma display panel displays an image thereon and biases the first electrodes at a first voltage while the image is being displayed on the plasma display panel. The chassis base is disposed opposite to the plasma display panel.

The driving board performs, in at least one subfield for a grouping of the plurality of second electrodes including a first group and a second group, the subfield having a plurality of address periods and a plurality of sustain periods that respectively correspond to the plurality of groups, the process of selecting turn-on cells among cells of the first and second groups during the address periods of the respective first and second groups. The driving board generates a sustain discharge in cells of a plurality of groups including at least the first and second groups by alternately applying second and third voltages to the plurality of second electrodes during a first sustain period provided between the address period of the first group and the address period of the second group among the plurality of sustain periods. The second and third voltages are respectively higher and lower than the first voltage. The driving board then generates a sustain discharge on cells of a plurality of groups including at least the first and second groups by alternately applying the second voltage and the third voltage to the plurality of second electrodes during a second sustain period provided after the address period of the second group among the plurality of sustain periods.

BRIEF DESCRIPTION OF THE DRAWINGS

FIG. 6 shows a driving method of a plasma display panel, which divides a scan electrode line into a plurality of groups and divides one frame into a plurality of subfields.

DETAILED DESCRIPTION

Figure 1:
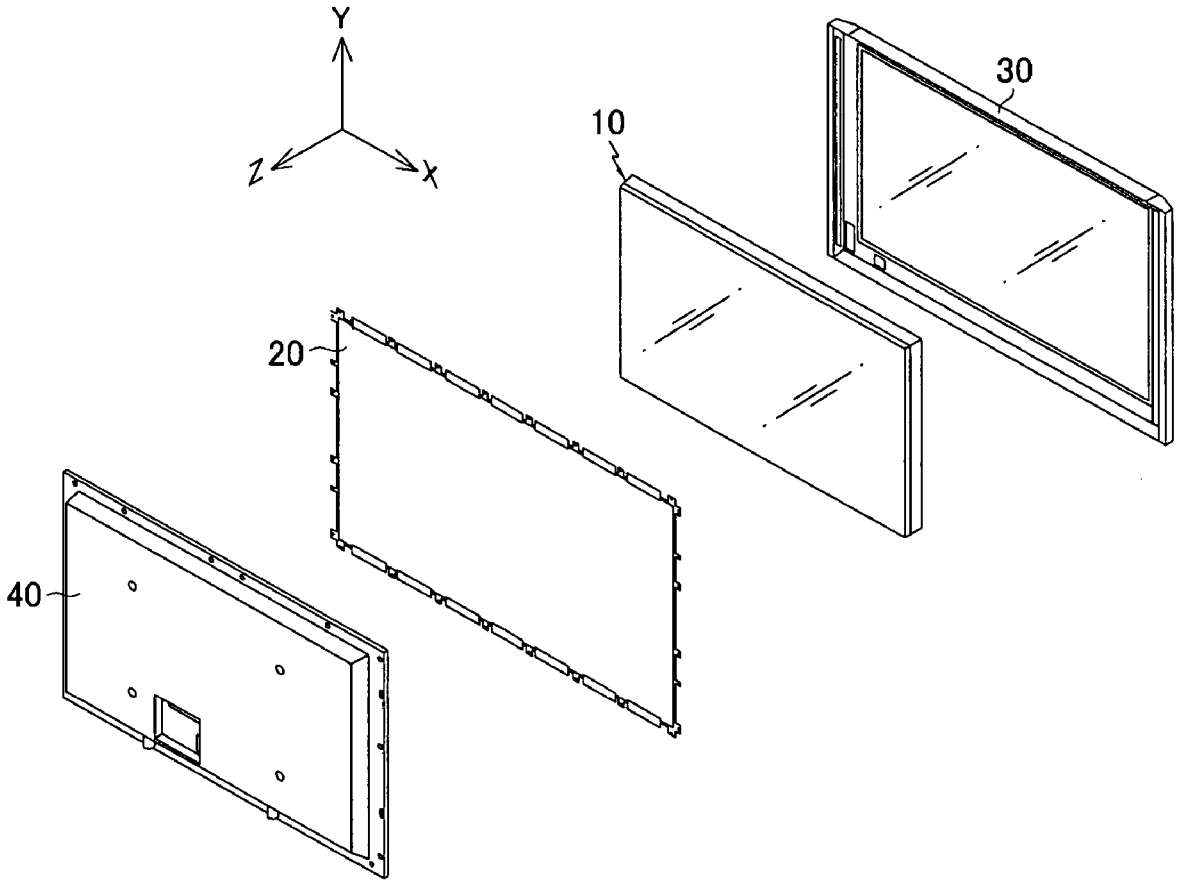
FIG. 1 is an exploded perspective view of a plasma display device according to an exemplary embodiment.

In the following detailed description, only certain exemplary embodiments of the invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Wall charges mentioned in the following description mean charges formed and accumulated on a wall (e.g., a dielectric layer) close to an electrode of a discharge cell. The wall charge will be described as being "formed" or "accumulated" on the electrode although the wall charges do not actually touch the electrodes. Further, a wall voltage may refer to a potential difference formed on the wall of the discharge cell by the wall charge.

A plasma display device and a driving method for a plasma display panel according to an exemplary embodiment are hereinafter described in detail with reference to the drawings.

First, a schematic structure of a plasma display device according to an exemplary embodiment is described in detail with reference to FIGS. 1 to 3.

Figure 2:
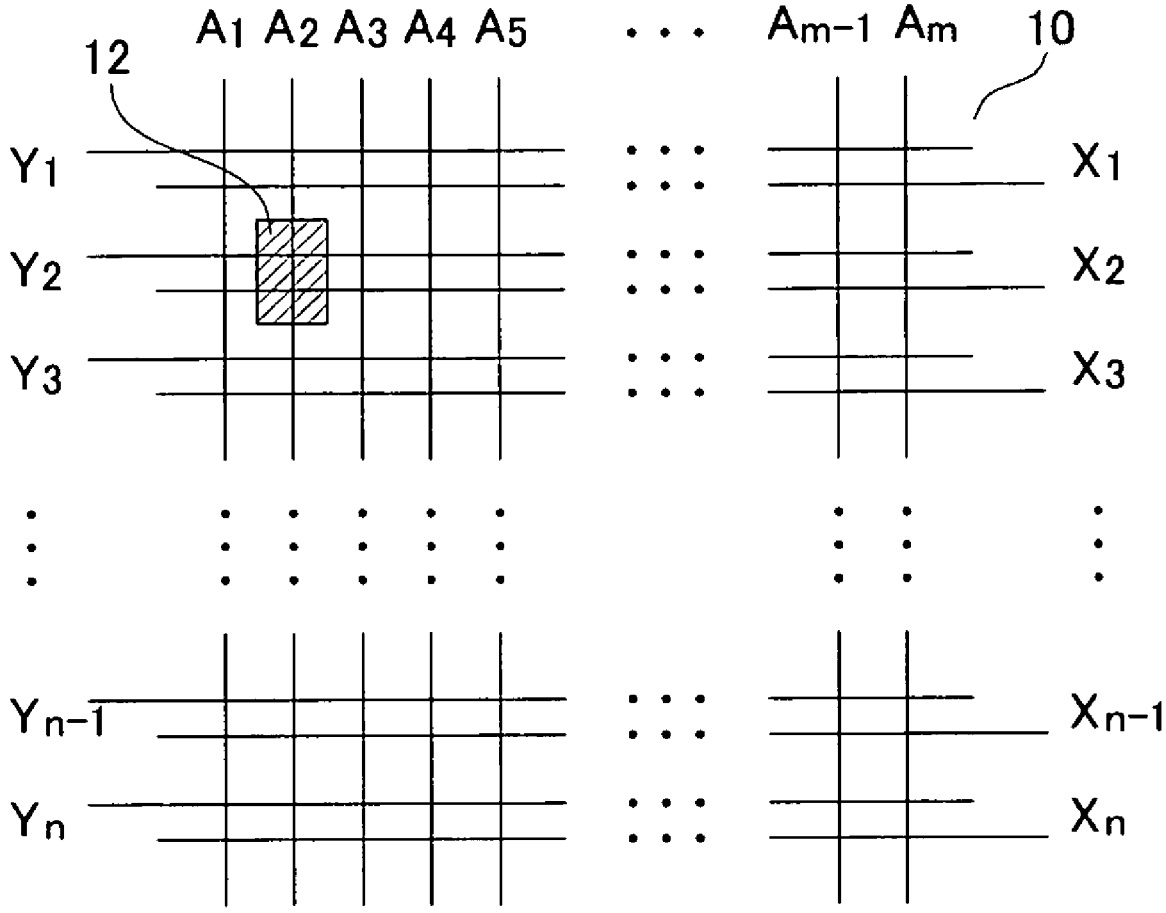
FIG. 2 is a schematic view of a plasma display panel according to an exemplary embodiment.

FIG. 1 is an exploded perspective view of a plasma display device according to an exemplary embodiment, and FIG. 2 is a schematic view of a plasma display panel according to an exemplary embodiment. FIG. 3 is a schematic top plan view of a chassis base according to an exemplary embodiment.

As shown in FIG. 1, a plasma display device includes a plasma display panel 10, a chassis base 20, a front case 30, and a rear case 40. The chassis base 20 is combined with the plasma display panel 10 and is disposed opposite to an image display side of the plasma display panel 10. Being respectively disposed to the front of the plasma display panel 10 and the rear of the chassis base 20, the front and rear cases 30 and 40 are respectively combined with the plasma display panel 10 and the chassis base 20 to form a plasma display device.

As shown in FIG. 2, the plasma display panel 10 includes a plurality of address electrodes A1-Am elongated in a vertical direction and a plurality of scan electrodes Y1-Yn and sustain electrodes X1-Xn each elongated in a horizontal direction. The sustain electrodes X1-Xn are formed in respective correspondence to the scan electrodes Y1-Yn, and ends of the sustain electrodes X1-Xn are connected in common. In addition, the plasma display panel 10 includes an insulation substrate (not shown) having sustain and scan electrodes X1-Xn and Y1-Yn formed thereon, and another insulation substrate (now shown) having address electrodes A1-Am formed thereon. The two insulation substrates are formed facing each other with an interposed discharge space and the address electrodes A1-Am are perpendicular to and cross the scan electrodes Y1-Yn and the sustain electrodes X1-Xn. The discharge space is formed in a region where the address electrodes A1-Am cross the sustain and scan electrodes X1-Xn and Yl-Yn and such a discharge space forms a cell 12.

Figure 3:
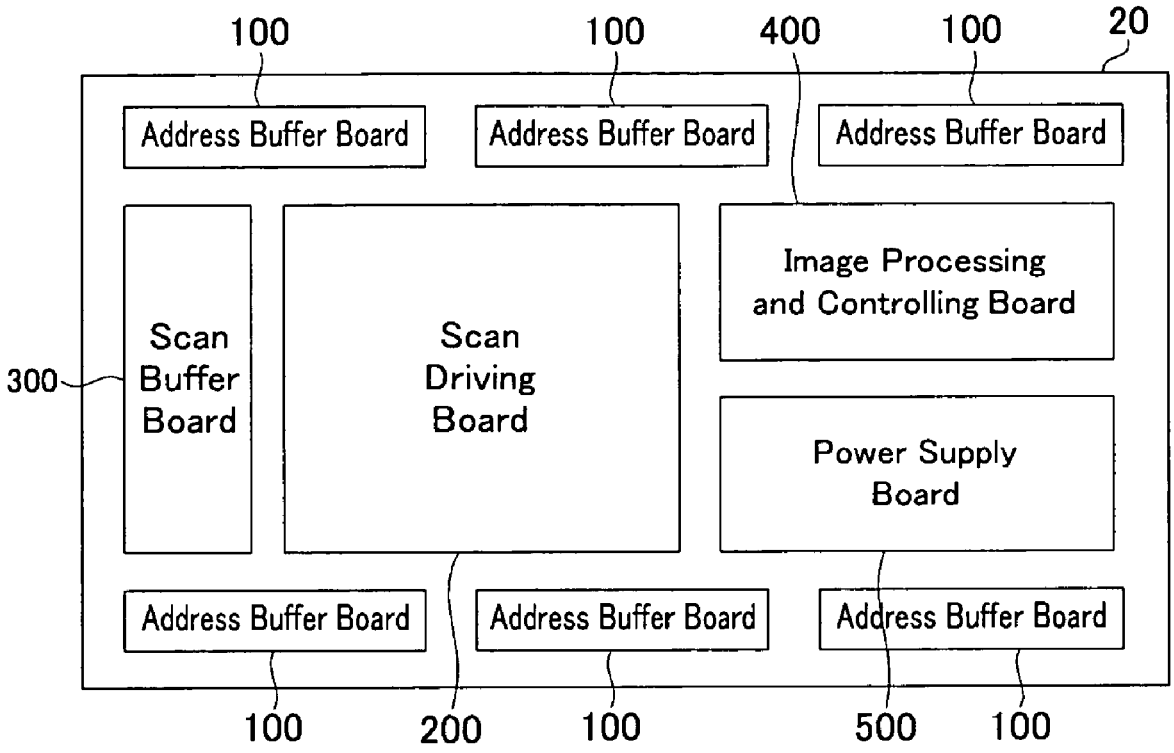
FIG. 3 is a schematic top plan view of a chassis base according to an exemplary embodiment.

As shown in FIG. 3, driving boards 100-500 for driving the plasma display panel 10 are formed on the chassis base 20. Address buffer boards 100, shown in upper and lower portions of the chassis base 20, may be formed as a single board or a plurality of boards. It is notable that FIG. 3 exemplarily illustrates a plasma display device driven by a dual driving method. In the case of a plasma display device driven by a signal driving method, the address buffer board 100 is disposed at either of the upper and lower portions of the chassis base 20. Such an address buffer board 100 receives an address driving control signal from an image processing and controlling board 400, and applies a voltage for selecting turn-on discharge cells (i.e., discharge cells to be turned on) to address electrodes A1-Am.

A scan driving board 200 is disposed to the left on the chassis base 20, and is coupled with the scan electrodes Y1-Yn through a scan buffer board 300. The sustain electrodes X1-Xn are biased at a predetermined voltage. The scan buffer board 300 applies a voltage to the scan electrodes Y1-Yn for sequential selection thereof during an address period. The scan driving board 200 receives driving signals from the image processing and controlling board 400, and applies the driving voltage to the scan electrodes Y1-Yn. In FIG. 3, the scan driving board 200 and the scan buffer board 300 are shown to be disposed to the left on the chassis base 20, however, they may be disposed to the right thereon. In addition, the scan buffer board 300 may be integrally formed with the scan driving board 200.

The image processing and controlling board 400 receives external image signals, generates control signals for driving the address electrodes A1-Am and control signals for driving the scan and sustain electrodes Y1-Yn and X1-Xn, and respectively applies them to the address driving board 100 and the scan driving board 200. A power supply board 500 supplies electric power for driving the plasma display device. The image processing and controlling board 400 and the power supply board 500 may be located at a central area of the chassis base 20.

A method for driving a plasma display device according to a first exemplary embodiment of the present invention is hereinafter described in detail with reference to FIG. 4.

Figure 4:
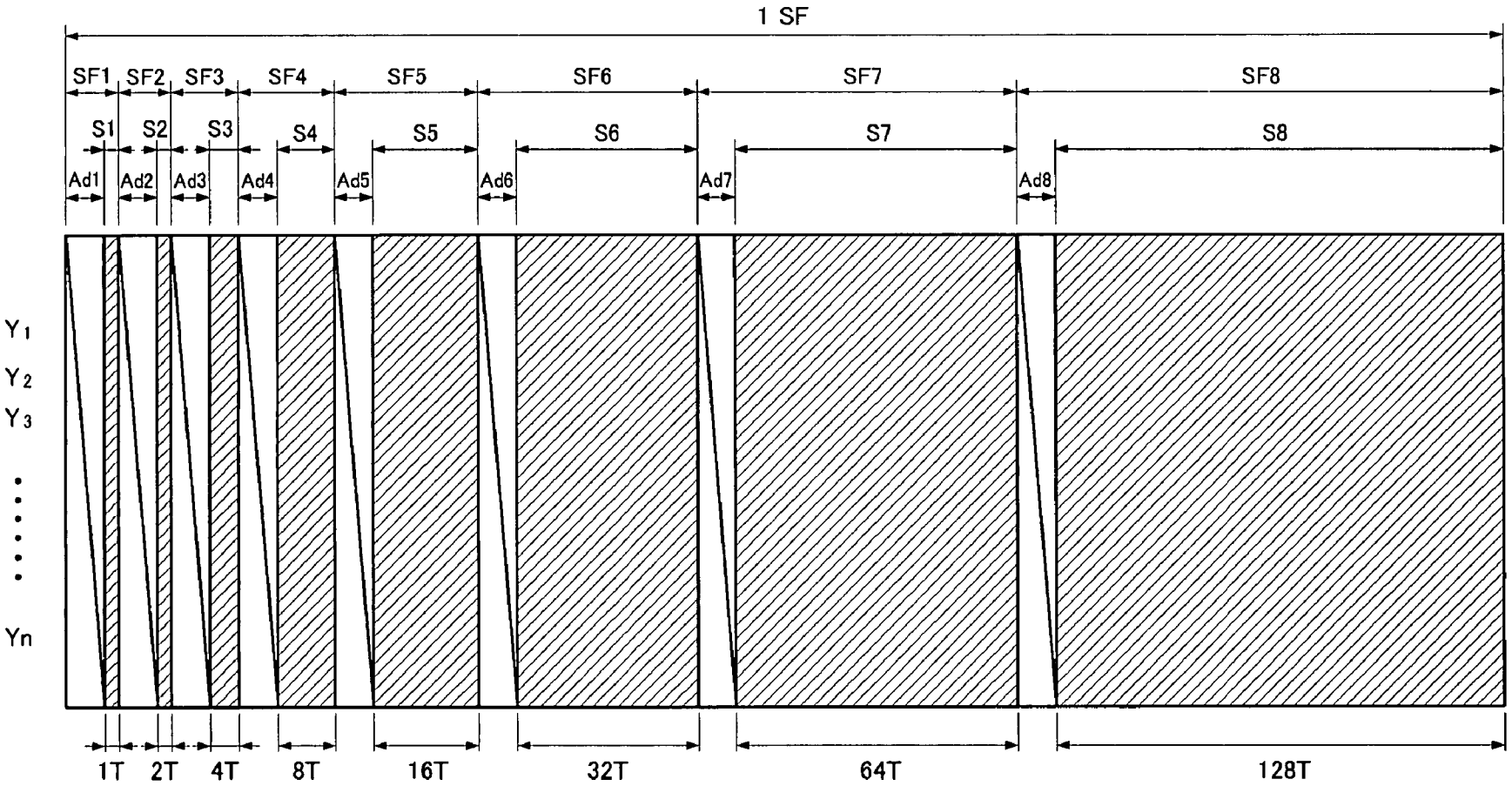
FIG. 4 shows a driving method of a plasma display device according to a first exemplary embodiment.

FIG. 4 shows a method for driving a plasma display device according to the first exemplary embodiment of the present invention.

As shown in FIG. 4, after the address operation is sequentially performed from the first scan line Y1 to the last scan line Yn, a sustain discharging is synchronously generated in every cell during the sustain period according to the first exemplarily embodiment. As shown in FIG. 4, one field is divided into a plurality of subfields SF1-SF8 with respective weight values of 1T, 2T, 4T, 8T, 16T, 32T, 64T, and 128T. The subfields are controlled by time division to thus represent gray scales.

Each of the subfields SF1 to SF8 includes a reset period (not shown), an address period Ad1-Ad8, and a sustain period S1-S8.

A driving waveform for the driving method of the plasma display panel according to the first exemplary embodiment is hereinafter described in detail with reference to FIG. 5.

Figure 5:
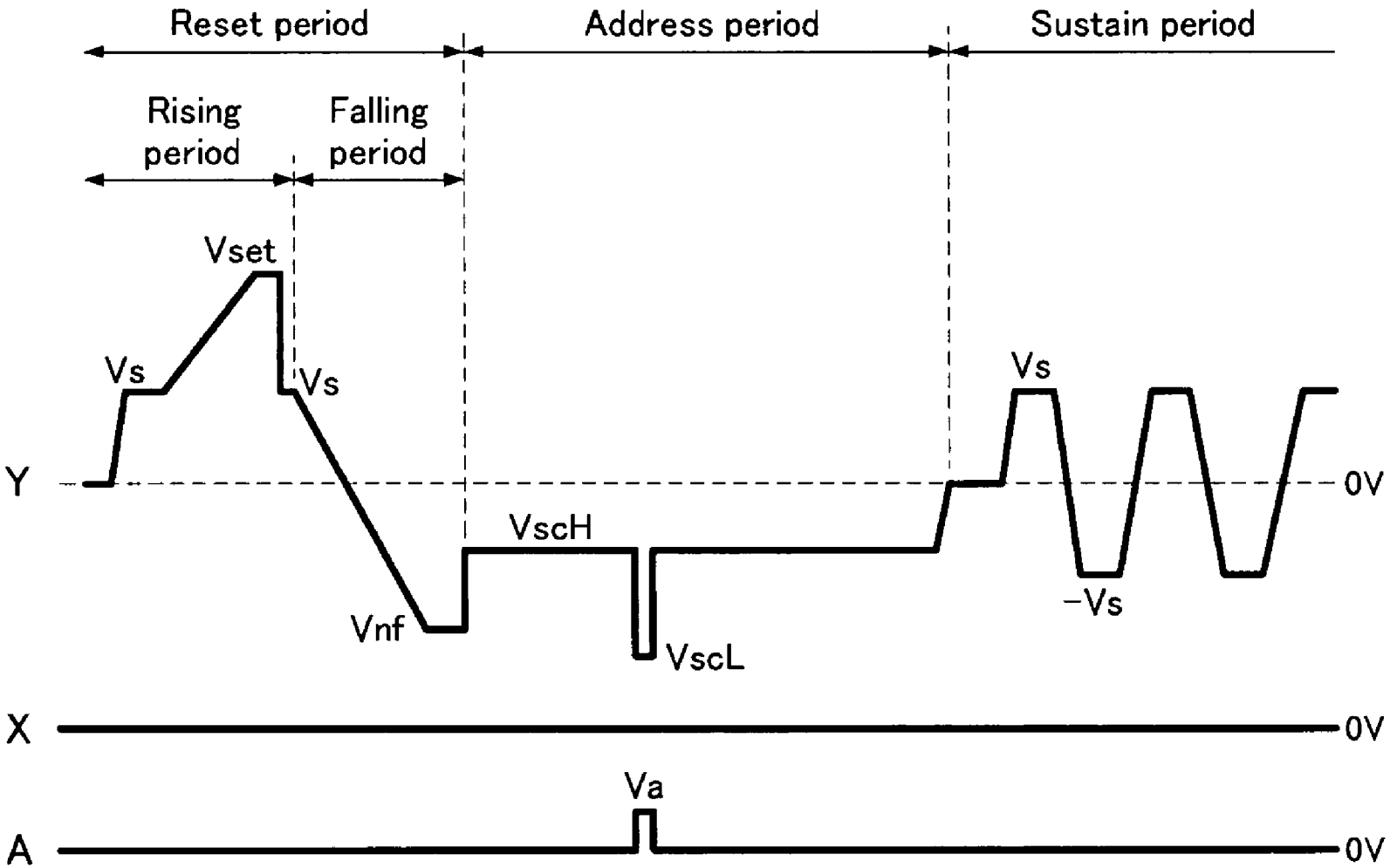
FIG. 5 is a waveform diagram according to a first exemplary embodiment.

FIG. 5 is a waveform diagram for the driving method according to the first exemplary embodiment. In the following description, the driving waveform applied to a scan electrode (hereinafter called a Y electrode), a sustain electrode (hereinafter called an X electrode), and an address electrode (hereinafter called an A electrode) is described in connection with only one cell, for better comprehension and convenience of description. In addition, in the driving waveform shown in FIG. 5, the voltage applied to the Y electrode is supplied from the scan driving board 200 and the scan buffer board 300, and the voltage applied to the A electrode is supplied from the address buffer board 100. Since the X electrode is biased at a reference voltage (refer to ground voltage in FIG. 5), the voltage applied to the X electrode is not described in further detail.

Referring to FIG. 5, a subfield includes a reset period, an address period, and a sustain period, wherein the reset period includes a rising period and a falling period.

During the rising period of the reset period, the voltage of the Y electrode is gradually increased from a voltage Vs to a voltage Vset while maintaining the A electrode at the reference voltage (0V in FIG. 5). FIG. 5 illustrates that the voltage of the Y electrode increases according to a ramp pattern. While the voltage of the Y electrode increases, a weak discharge occurs between the Y and X electrodes and between the Y and A electrodes. Accordingly, negative (−) wall charges are formed on the Y electrode, and positive (+) wall charges are formed on the X electrode and A electrodes. When the voltage of the Y electrode gradually changes as shown in FIG. 5, a weak discharge occurring in a cell forms wall charges such that a sum of an externally applied voltage and the wall charge may be maintained at a discharge firing voltage. Such a process of forming wall charges is disclosed in U.S. Pat. No. 5,745,086 by Weber. The voltage Vset is a voltage high enough to fire a discharge in cells of any condition because every cell has to be initialized in the reset period. In addition, the voltage Vs equals the voltage applied to the Y electrode in the sustain period and is lower than a discharge firing voltage between the Y and X electrodes.

During the falling period of the reset period, the voltage of the Y electrode is gradually decreased from the voltage Vs to a negative voltage Vnf while maintaining the A electrode at the reference voltage. While the voltage of the Y electrode decreases, a weak discharge occurs between the Y and X electrodes and between the Y and A electrodes. Accordingly, the negative (−) wall charges formed on the Y electrode and the positive (+) wall charges formed on the X and A electrodes are eliminated. The voltage Vnf is usually set close to a discharge firing voltage between the Y and X electrodes. Then, the wall voltage between the Y and X electrodes becomes near 0V, and accordingly, a discharge cell that has not experienced an address discharge in the address period may be prevented from misfiring during the sustain period. In addition, the wall voltage between the Y and A electrodes is determined by the level of the voltage Vnf, because the A electrode is maintained at the reference voltage.

During the address period for selection of turn-on cells, a scan pulse of a negative voltage VscL, and an address pulse of a positive voltage Va are respectively applied to Y and A electrodes of the turn-on cells. Non-selected Y electrodes are biased at a voltage VscH that is higher than the voltage VscL, and the reference voltage is applied to the A electrode of the turn-off cells (e.g., cells to be turned off). Herein, the voltage VscL is called a scan voltage, and the voltage VscH is called a non-scan voltage.

For such an operation, the scan buffer board 300 selects a Y electrode to be applied with the scan pulse VscL, among the Y electrodes Y1 to Yn. For example, in a single driving method, the Y electrode may be selected according to an order of arrangement of the Y electrodes in the vertical direction.

When a Y electrode is selected, the address buffer board 100 selects turn-on cells among cells formed on the selected Y electrode. That is, the address buffer board 100 selects A electrodes to which the address pulse of the voltage Va is applied among the A electrodes Al to Am.

In more detail, the scan pulse of the voltage VscL is first applied to the scan electrode (Y1 shown in FIG. 2) of a first row, and at the same time, the address pulse of the voltage Va is applied to an A electrode of a turn-on cell in the first row. Then a discharge is generated between the Y electrode of the first row and the A electrode applied with the voltage Va, and accordingly, positive (+) wall charges are formed on the Y electrode and negative (−) wall charges are formed on the A and X electrodes. As a result, a wall voltage Vwxy is formed between the X and Y electrodes such that a potential of the Y electrode becomes higher than the same of the X electrode. Subsequently, the address pulse of the voltage Va is applied to the A electrodes of turn-on cells in a second row while the scan voltage of the voltage VscL is applied to the Y electrode (Y2 in FIG. 2) in the second row. Then, the address discharge is generated in the cells crossed by the A electrodes applied with the voltage Va and the Y electrode in the second row, and accordingly, the wall charges are formed in such cells, in a like manner as described above. Regarding Y electrodes in other rows, wall charges are formed in turn-on cells in the same manner as has been described above, i.e., by applying the address pulse of the voltage Va to A electrodes of turn-on cells while sequentially applying a scan pulse of the voltage VscL to the Y electrodes.

In such an address period, a level of the voltage VscL is usually less than or equal to a level of the voltage Vnf, and the voltage Va is usually set greater than the reference voltage. Generation of the address discharge by applying the voltage Va to the A electrode is hereinafter described in connection with the case that the voltage VscL equals the voltage Vnf. When the voltage Vnf is applied in the reset period, a sum of the wall voltage between the A and Y electrodes reaches the discharge firing voltage Vfay between the A and Y electrodes. When the A electrode is applied with 0V and the Y electrode is applied with the voltage VscL (=Vnf), the voltage Vfay is formed between the A and Y electrodes, and accordingly the discharge may be expected to be generated. However, actually, in this case, the discharge is not generated because a discharge delay is greater than the width of the scan pulse and the address pulse. However, if the voltage Va is applied to the A electrode while the voltage VscL(=Vnf) is applied to the Y electrode, a voltage greater than the voltage Vfay is formed between the A and Y electrodes such that the discharge delay is reduced to less than the width of the scan pulse. Therefore, in this case, the discharge may be generated. At this time, generation of the address discharge may be facilitated by setting the voltage VscL to be less than the voltage Vnf.

Subsequently in the sustain period, a sustain discharge is triggered between the Y and X electrodes-by initially applying a pulse of the voltage Vs to the Y electrode, since, in the cells that have experienced an address discharge in the address period, the wall voltage Vwxy is formed such that the potential of the Y electrode is higher than the same of the X electrode. In this case, the voltage Vs is set such that it is lower than the discharge firing voltage Vfxy and a voltage value Vs+Vwxy is higher than the voltage Vfxy. As a result of such a sustain discharge, negative (−) wall charges are formed on the Y electrode and positive (+) wall charges are formed on the X and A electrodes, such that the potential of the X electrode is higher than the same of the Y electrode.

Because the wall voltage Vwxy is formed such that the potential of the Y electrode becomes higher than the X electrode, a pulse of a negative voltage −Vs is applied to the Y electrode to fire a subsequent sustain discharge. Therefore, positive (+) wall charges are formed on the Y electrode and negative (−) wall charges are formed on the X and A electrodes, such that another sustain discharge may be fired by applying the voltage Vs to the Y electrode. Subsequently, the process of alternately applying the sustain pulses of voltages Vs and −Vs to the scan electrode Y is repeated by the number of times corresponding to a weight value of a corresponding subfield.

As described above, according to the first exemplary embodiment, reset, address, and sustain operations may be performed by a driving waveform applied only to the Y electrode while the X electrode is biased at the reference voltage. Therefore, a driving board for driving the X electrode is not required, and the X electrode may be simply biased at the reference voltage. In addition, waveform distortion due to a parasitic component may be prevented since the sustain pulse is applied only to the Y electrode.

For driving the plasma display device according to the first exemplary embodiment, the address operation is sequentially performed from the first Y electrode Y1 to the last Y electrode Yn as shown in FIG. 4, and the sustain discharge is synchronously generated in every selected cell after turn-on or completion of the sequential address operation. In other words, when an address operation is performed on-one of Y electrodes, a sustain discharge is generated in the Y electrode only after the address operation is performed on the last Y electrode. Therefore, a time gap between an address operation and generation of a sustain discharge in a cell may be long enough to cause generation of the sustain discharge to be unstable.

A driving method provided for solving the foregoing problem according to a second exemplary embodiment of the present invention is hereinafter described with reference to FIGS. 6 to 9.

Hereinafter, a method for driving a plasma display device according to the second exemplary embodiment of the present invention will be described in detail with reference to FIGS. 6 and 7.

As shown in FIG. 6, scan electrode lines are grouped into n groups G1 to Gn, and a frame of each group is divided into a plurality of subfields for driving the plasma display device. In FIG. 6, each group represents grayscale values using a combination of 8 subfields.

When grouping scan electrodes into a plurality of groups, a given number of scan electrodes may be sequentially grouped. For example, when a panel has 800 scan electrodes, the 800 scan electrodes are sequentially grouped into 8 groups, the $1^{st}$ to the $100^{th}$ scan electrodes may be grouped into a first group, and the $101^{st}$ to the $200^{th}$ scan electrodes may be grouped into a second group, etc. In another embodiment, when grouping the scan electrodes, scan electrodes that are spaced at regular intervals may be grouped rather than grouping sequentially adjacent scan electrodes. In other words, the first, the ninth, the seventeenth, . . . , the (8k+1)th scan electrodes are grouped into the first group, and the second, the tenth, the eighteenth, . . . , the (8k+2)th scan electrodes are grouped into the second group, etc. It is also possible to group scan electrodes at random as necessary.

Figure 7:
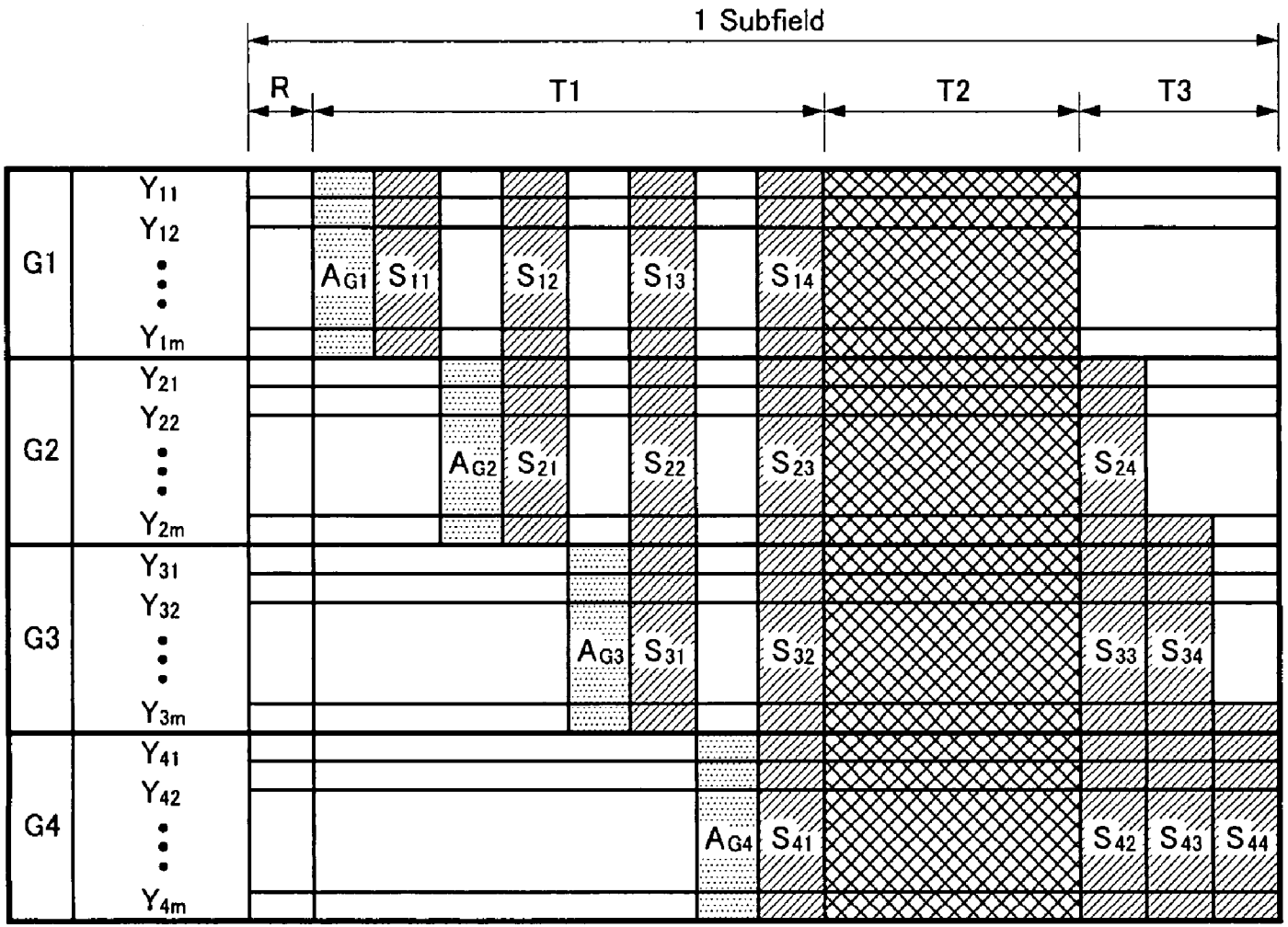
FIG. 7 shows a structure of a subfield according to a second exemplary embodiment of the present invention.

FIG. 7 shows a subfield structure for the driving method according to the second exemplary embodiment of the present invention. In particular, FIG. 7 shows a structure of one subfield (SF1) in the case that scan electrodes of a plasma display panel are grouped into 4 groups G1, G2, G3, and G4. The subfield SF1 includes a reset period R, an address/sustain combination period T1, a common sustain period T2, and a brightness correction period T3.

The reset period R is for initializing the state of wall charges in every cell by applying a reset waveform to every scan electrode.

During the address/sustain combination period T1, an address operation $A_{G1}$ is sequentially performed from the first electrode $Y_{11}$ to the last electrode $Y_{1m}$ of the group G1. When the address operation $A_{G1}$ has been performed on every cell in the first group G1, a sustain operation is performed on every cell of the first group G1 during a first sustain period $S_{11}$.

After the first sustain period $S_{11}$ for the first group G1 is finished, an address operation $A_{G2}$ is performed on every cell of the second group G2 during an address period $A_{G2}$.

After completion of the address period $A_{G2}$ for a second group G2, that is when scan electrodes $Y_{21}, Y_{22}, \ldots, Y_{2m}$ of the second group G2 are addressed, a first sustain period $S_{21}$ operation is performed on the second group G2. At this time, a second sustain period $S_{12}$ operation is performed on the first group G1 that has experienced the address period $A_{G1}$. However, if the first group represents satisfactory grayscale values during the first sustain period $S_{11}$, the second sustain period $S_{12}$ operation for the first group may not need to be performed. Cells that have not experienced an address period are maintained in the state of being turned-off.

When the first sustain period $S_{21}$ for the second group G2 is finished, an address period $A_{G3}$ and a first sustain period $S_{31}$ operation are performed on the third group G3 in a like manner as above, and operations for sustain periods $S_{13}$ and $S_{22}$ may be performed on the first and second groups that have experienced the address periods while the first sustain period $S_{31}$ operation is performed on the third group G3. However, if the first and second groups represent satisfactory grayscale values during the first sustain periods $S_{11}$ and $S_{21}$, additional operations for sustain periods $S_{13}$ and $S_{22}$ may not need to be performed.

Operations for an address period $A_{G4}$ and a first sustain period $S_{41}$ are performed on the fourth group G4 in a like manner as above, and operations for sustain periods $S_{14}$, $S_{23}$, and $S_{32}$ may be performed on every cell in the first, second, and third groups G1, G2, and G3 that have experienced the address periods while the first sustain period $S_{41}$ operation is performed on the fourth group G4.

FIG. 7 exemplarily shows that a sustain period operation is performed on cells in a group that have experienced an address period while the sustain period operation is performed on cells in other groups. If it is assumed that each sustain period is applied with the same amount of sustain pulses and accordingly generates the same amount of brightness, cells in the first group may generate brightness n times greater than the same generated by cells in an n-th group. In the same way, cells in the second group may generate brightness (n−1) times greater than the same generated by cells in the nth group, and cells in a G(n−1)-th group may generate brightness 2 times greater than the same generated by cells in the n-th group. Therefore, brightness correction is additionally required to equally correct such a brightness difference in each group.

The brightness correction period T3 operation is selectively performed on each group in order to equally correct grayscale value represented by cells in each group to be equal.

The common sustain period T2 is a period for synchronously applying sustain pulses to every cell for a given period of time, and may be selectively performed when grayscale values assigned to each subfield may not be satisfactorily represented during the address/sustain combination period T1, or during the address/sustain combination period T1 and the brightness correction period T3. The common sustain period T2, as shown in FIG. 7, may be performed after the address/sustain combination period T1 is performed, or after the brightness correction period T3 is performed.

In addition, a length of the common sustain period T2 may be changed according to a weight value of a subfield.

In addition, one subfield may be realized by only the address/sustain combination period T1. In more detail, after completion of the address and sustain operations on a group, the address and sustain operations are sequentially performed to the next consecutive group. The address/sustain period operations are sequentially performed from the first group G1 to the fourth group G4.

Figure 8:
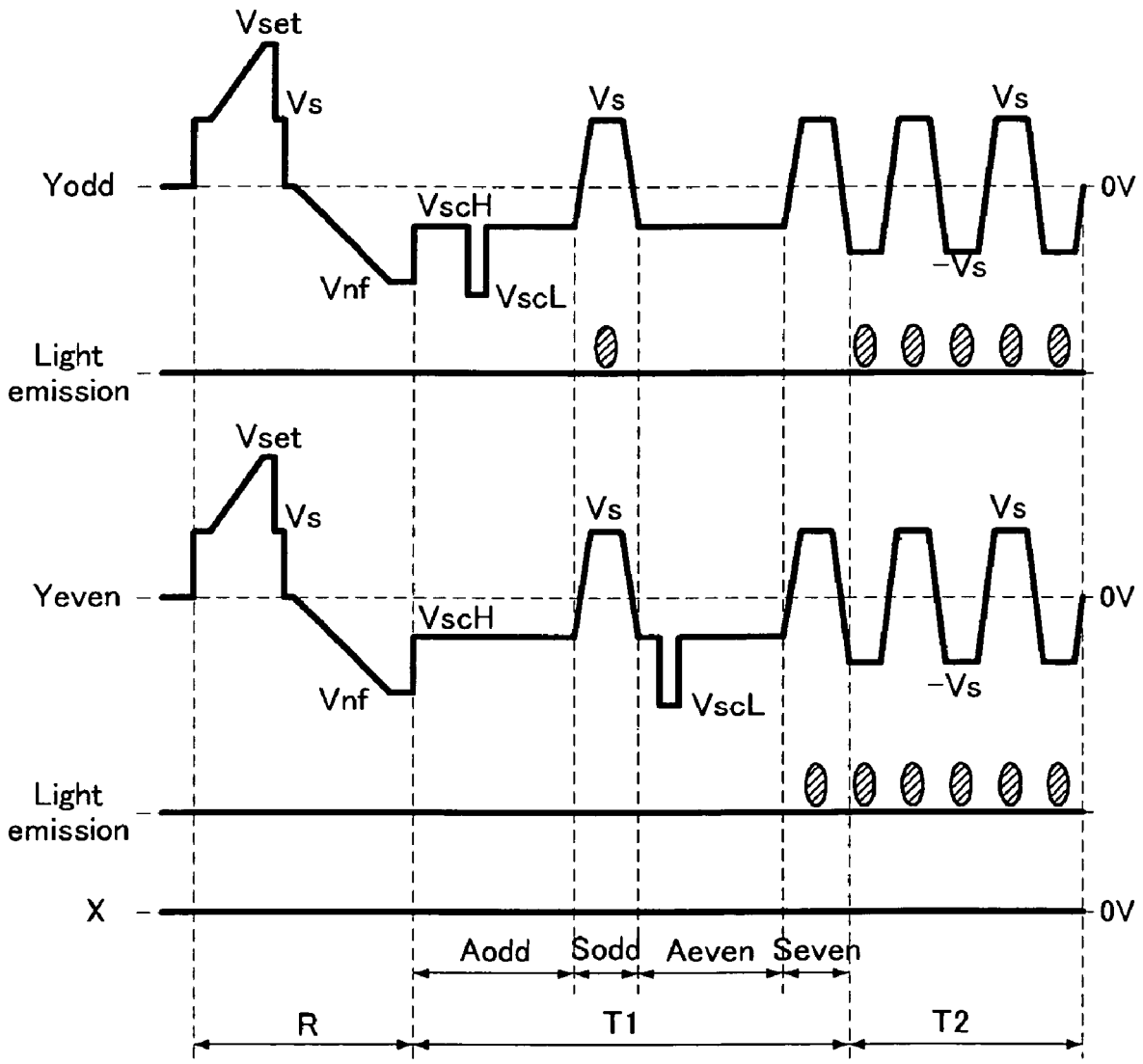
FIG. 8 exemplarily shows a waveform according to the second exemplary embodiment.

FIG. 8 exemplarily shows driving waveforms for the driving method according to the second exemplary embodiment. FIG. 8 shows a driving waveform diagram of a plasma display device. The waveforms are applied to a scan electrode (Yodd electrode) in an odd-numbered group, a scan electrode (Yeven electrode) in an even numbered group, and an X electrode according to the driving method of FIG. 6 and FIG. 7

Unlike FIG. 6 and FIG. 7, FIG. 8 shows that Y electrodes are grouped into an odd-numbered group and an even-numbered group.

During a reset period R, a reset waveform is applied to Yodd and Yeven electrodes in the odd-numbered and even-numbered groups, respectively, in order to initialize the state of the wall charges in the cells. The reset waveform of FIG. 8 is the same as the waveform of FIG. 5, and therefore a detailed description will not be provided.

During the address/sustain combination period T1, an address period Aodd is performed on Yodd electrodes grouped in the odd numbered group first, and a sustain period Sodd is performed thereon. When after the sustain period Sodd is performed on the Yodd electrodes in the odd-numbered group, an address period Aeven is performed on Yeven electrodes grouped in the even-numbered group. Then the second sustain period $S_{12}$ operation and the first sustain period $S_{21}$ operation are synchronously performed on the Yodd electrodes in the odd-numbered group and the Yeven electrodes in the even-numbered group, respectively.

In more detail, the Yodd electrodes in the odd-numbered group first experience the address period Aodd operation during the address/sustain combination period T1. During the address period Aodd, a scan pulse of a voltage VscL is sequentially applied to the Yodd electrodes in the odd-numbered group while the Yeven electrodes in the even-numbered group are maintained at a voltage VscH. In addition, although it is not shown in FIG. 8, an address voltage is applied to an A electrode in a turn-on cell (a cell to be turned on) among cells formed by Y electrodes applied with the scan pulse. Then an address discharge is generated by a voltage difference between the address voltage applied to the A electrode and the voltage VscL applied to the Y electrode and a wall voltage due to wall charges formed on the A and Y electrodes, and accordingly, a wall voltage is formed between the Y and X electrodes.

During a sustain period Sodd of the address/sustain combination period T1, a sustain pulse is applied to the Yodd and Yeven electrodes while the X electrode is biased at the reference voltage. Referring to FIG. 8, the sustain pulse is applied to the Yodd and Yeven electrode once. In addition, the sustain pulse has a high level voltage (Vs in FIG. 8) and a low level voltage (−Vs in FIG. 8), and a sustain discharge may be generated due to a wall voltage and the Vs voltage or −Vs voltage. The Yodd and Yeven electrodes are applied with the voltage Vs while the X electrode is biased at a reference voltage (0V in FIG. 8). In a cell where a wall voltage is formed between a Yodd electrode and an X electrode due to the address discharge during the address period Aodd, the wall voltage and a voltage difference Vs between the Yodd electrode and the X electrode causes a sustain discharge such that wall voltages of opposite polarities are respectively formed in the Yodd electrode and the X electrode. On the other hand, although a sustain pulse of the voltage Vs is applied to a Yeven electrode in an even-numbered group during the sustain period Sodd of the address/sustain combination period T1, a sustain discharge is not generated in a discharge cell since a wall voltage is not formed between the Yeven electrode and an X electrode of the even-numbered group. After the address period Aodd and sustain period Sodd are performed on the Yodd electrodes in the odd-numbered group, an address period Aeven and a sustain period Seven of the address/sustain combination period T1 are sequentially performed on the Yeven electrodes in the even-numbered group.

While the Yodd electrodes of the odd-numbered group are maintained at a voltage VscH during the address period Aeven of the address/sustain combination period T1, the Yeven electrodes of the even-numbered group are sequentially applied with the scan pulse of the voltage VscL. As described above, an address voltage is applied to an Aeven electrode of a turn-on cell among cells formed by the Y electrodes which are applied with the voltage VscL, and accordingly, a wall voltage is formed. It is notable that the sustain period Sodd and the address period Aeven are separated in FIG. 8, but the two periods may be partially overlapped with the address period Aeven.

In addition, a sustain pulse is applied to the Yodd and Yeven electrodes while the X electrode is biased at the reference voltage (0V) during a sustain period Seven of the address/sustain combination period T1. Similar to the sustain pulse applied during the sustain period Sodd, the sustain pulse has a high level voltage (Vs in FIG. 8) and a low level voltage (−V in FIG. 8), and a sustain discharge may be generated due to a wall voltage and the Vs voltage or −Vs voltage. It is notable that the sustain discharge is generated in a cell that has experienced the address period Aeven and thus a wall voltage is formed thereon among cells formed by the Yeven electrodes of the even-numbered group. However, it is also notable that a sustain discharge may be generated in a cell in which a wall voltage is formed during the address period Aodd among cells of the Yodd electrodes in the odd-numbered group when a high level voltage is applied to the cell during the sustain period Seven while positive (+) wall charges are formed thereon.

During the common sustain period T2, the sustain pulses having the high level voltage and the low level voltage are alternately applied to the Yodd and Yeven electrodes and the X electrode is biased at the reference voltage (0V) such that the sustain operation is commonly performed on the Yodd and Yeven electrodes.

Therefore, a discharge operation is performed 6 times on the Yodd electrodes of the odd-numbered group and the Yeven electrodes of the even-numbered group in the subfield of FIG. 8, respectively.

According to the subfield of FIG. 8, the additional brightness correction period T3 shown in FIG. 7 is not required, since the number of the sustain discharges is generated by the same number in the Yodd electrodes of the odd-numbered group and the Yeven electrodes of the even-numbered group during the address/sustain combination period T1.

In the driving waveform of FIG. 8, however, a misfiring may be generated in the Yodd electrodes of the odd-numbered group while the address period Aeven is performed on the Yeven electrodes of the even-numbered group during the address/sustain combination period T1.

In other words, when the high level voltage is applied to the Yodd electrodes of the odd-numbered group during the sustain period Sodd of the address/sustain combination period T1, negative (−) wall charges are accumulated to the Yodd electrode of the odd-numbered group.

Then, during the address period Aeven, the voltage VscH applied to the Yodd electrode of the odd-numbered group is lower than a voltage (0V in FIG. 8) applied to the X electrode, and accordingly, misfiring may be generated in a cell where a large wall voltage is formed between the Yodd electrode of the odd-numbered group and the X electrode due to a voltage difference VscH between the Yodd electrode of the odd-numbered group and the X electrode.

Therefore, when the misfiring is generated in a cell on the Yodd electrode of the odd-numbered group during the address period Aeven, the brightness of the odd-numbered group becomes unstable because the number of sustain discharges is not generated in the same number as in the Yeven electrodes of the even-numbered group and the Yodd electrodes of the odd-numbered group. Another driving waveform for solving the foregoing problem is hereinafter described with reference to FIG. 9.

Figure 9:
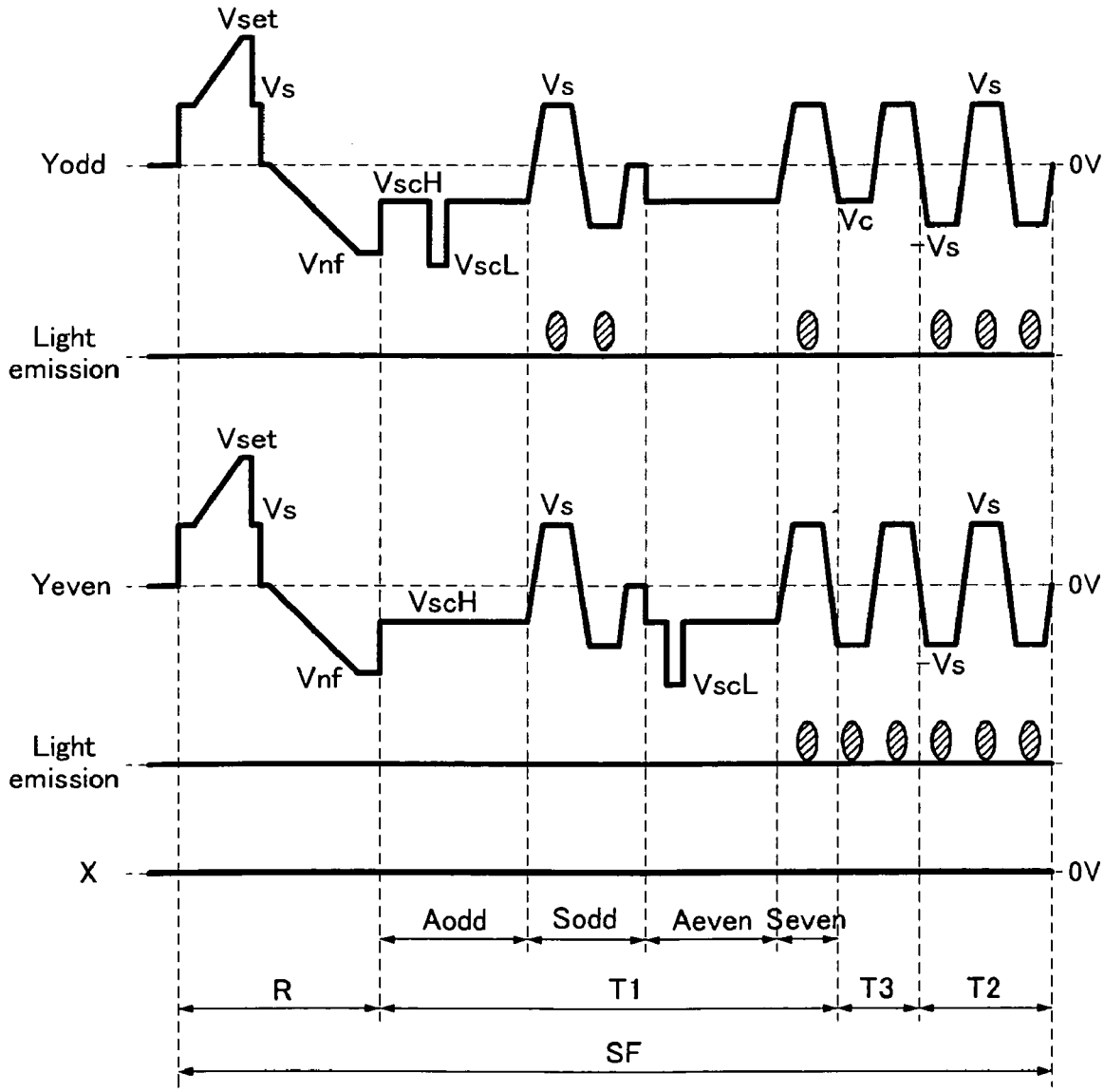
FIG. 9 shows another waveform according the second exemplary embodiment.

FIG. 9 exemplarily illustrates a waveform of another driving method according to the second exemplary embodiment. As shown in FIG. 9, one subfield includes a reset period R, an address/sustain combination period T1, a common sustain period T2, and a brightness correction period T3. Unlike the common sustain period T2 of FIG. 7, the common sustain period T2 of FIG. 9 is performed after the brightness correction period T3 is performed.

The reset period R includes a rising period and a falling period, and initializes the state of a wall charge of a cell by applying a reset waveform to every Yodd and Yeven electrode. The reset waveform of FIG. 9 is the same as that of FIG. 5, and thus it is not described in further detail. Similar to FIG. 8, during the address/sustain combination period T1, the address period Aodd operation and the sustain period Sodd operation are performed on the Yodd electrodes of the odd-numbered group first and the address period Aeven operation and the sustain period Seven operation are performed on the Yeven electrodes of the even-numbered group while the X electrode is biased at the reference voltage (0V in FIG. 9).

As shown in FIG. 9, unlike the driving waveform of FIG. 8, the Yodd electrodes of the odd-numbered group and the Yeven electrodes of the even-numbered group are respectively applied with a high level voltage (Vs in FIG. 9) and a low level voltage (−Vs in FIG. 9) once during the sustain period Sodd.

The last voltage applied to the Yodd electrodes of the odd-numbered group is the −Vs voltage, and accordingly, positive (+) wall charges are accumulated to the Yodd electrodes of the odd-numbered group. Because the voltage VscH applied to the Yodd electrodes of the odd-numbered group is lower than a voltage (0V in FIG. 9) applied to the X electrode, misfiring is not generated between the Yodd electrode of the odd-numbered group and the X electrode during the period Aeven.

In addition, a sustain discharge is generated in the Yeven electrodes of the even-numbered group and the Yodd electrodes of the odd numbered group when the high level voltage is applied to every Yodd and Yeven electrode due to the positive (+) wall charges accumulated on the Yodd electrodes of the odd-numbered group.

Therefore, unlike FIG. 8, every Yodd electrode in the odd-numbered group and every Yeven electrode in the even-numbered group experience the sustain discharge in FIG. 9.

As a result, the number of sustain discharges is not the same for the Yodd electrodes of the odd-numbered group and the Yeven electrodes of the even-numbered group, and accordingly, the brightness correction period T3 is provided to correct the difference.

The brightness correction period T3 is a sustain discharge period selectively performed for each group such that gray-scale values represented by each group are equally corrected to be equal.

In other words, the sustain discharge is set to be generated only in the Yeven electrodes of the even-numbered group and thus the Yodd electrodes of the odd-numbered group do not experience the sustain discharge during the brightness correction period T3, such that brightness generated by a cell formed by the Yodd electrode of the odd-numbered group becomes the same as brightness generated by a cell formed by the Yeven electrode of the even-numbered group.

Therefore, as shown in FIG. 9, during the brightness correction period T3, the Yeven electrodes of the even-numbered group are applied with the −Vs voltage and the Yodd electrodes of the even-numbered group are applied with a voltage Vc having a voltage level higher than the −Vs voltage. Then, a voltage difference between Yodd electrodes of the odd-numbered group and the Yeven electrodes of the even-numbered group is reduced such that only the Yeven electrodes of the even-numbered group experience the sustain discharge. Then, the voltage Vs is applied to the Yodd electrodes of the odd-numbered group and the Yeven electrodes of the even-numbered group. Then, negative (−) wall charges are accumulated on the Yodd electrode of the odd-numbered group because the Yodd electrodes of the odd-numbered group have not experienced the sustain discharge before, and the sustain discharge is generated only in the Yeven electrodes of the even-numbered group.

In this way, the number of sustain discharges generated in the Yodd electrodes of the odd-numbered group during the brightness correction period T3 is limited to the number of sustain discharges generated in the Yeven electrodes of the even-numbered group during the address/sustain combination period T1. Accordingly, the brightness of the Yodd electrodes of the odd-numbered group equals that of the Yeven electrodes of the even-numbered group.

During the common sustain period T2, a sustain pulse is applied to the Yodd electrodes of the odd-numbered group and the Yeven electrodes of the even-numbered group, and accordingly, a sustain discharge is commonly performed on the Yodd and Yeven electrodes.

As described above, the driving waveform is applied only to the scan electrode while the sustain electrode is maintained at a constant voltage. Therefore, it is possible to realize a combined board driven by a single board, and accordingly, the cost decreases because of using the single board.

In addition, the driving of cells that form a display panel may be performed for each electrode on which the cells are formed without using an additional driving circuit. In addition, when driving the cells for each electrode without using the additional driving circuit and representing grayscale values using a frame-subfield method, a time gap between the address period and the sustain period is minimized to improve generation of the sustain discharge.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A driving method of a plasma display device that divides one frame into a plurality of subfields, the plasma display device having a plurality of first electrodes and a plurality of second electrodes, the plurality of second electrodes being grouped into a plurality of groups including a first group and a second group, the driving method comprising, in at least one subfield including a plurality of address periods and a plurality of sustain periods respectively corresponding to the plurality of groups:

selecting turn-on cells from discharge cells corresponding to the first group and the second group during the plurality of address periods;

generating a sustain discharge in discharge cells corresponding to the plurality of groups including the first group by alternately applying a second voltage and a third voltage to the plurality of second electrodes while the plurality of first electrodes are biased at a first voltage, during a first sustain period among the plurality of sustain periods, where the first sustain period is provided between the address periods of the first group and the address period of the second group, wherein the second voltage and third voltage are respectively higher and lower than the first voltage; and generating a sustain discharge in cells of a plurality of groups including at least the first group and the second group by alternately applying a fourth voltage and a fifth voltage to the plurality of second electrodes while the plurality of first electrodes are biased at the first voltage, during a second sustain period provided after the address period of the second group, wherein the fourth voltage and the fifth voltage are respectively higher and lower than the first voltage.

2. The driving method of claim 1, wherein the plurality of first electrodes are biased at the first voltage during the address periods of the first group and the second group.

3. The driving method of claim 2, wherein a last voltage applied during the first sustain period is set to be the third voltage.

4. The driving method of claim 3, further comprising applying a sixth voltage that is higher than the fourth voltage and lower than the fifth voltage at least once to a second electrode of the first group while the plurality of first electrodes are biased at the first voltage during the second sustain period.

5. The driving method of claim 4, wherein a second electrode of the second group is applied with the fifth voltage while the sixth voltage is applied to the second electrode of the first group.

6. The driving method of claim 4, wherein the fourth voltage and the fifth voltage are alternately applied to the plurality of second electrodes during the second sustain period, excluding a period during which the sixth voltage is being applied.

7. The driving method of claim 4, wherein a sustain discharge is not generated in a discharge cell on the second electrode of the first group due to the sixth voltage being applied to the second electrode of the first group and a seventh voltage being applied to the second electrode of the first group, subsequent to the sixth voltage.

8. The driving method of claim 1, wherein the first voltage is set to be a ground voltage.

9. The driving method claim 1, wherein the second voltage and third voltage have a same magnitude and opposite polarities, wherein the fourth voltage and the fifth voltage have a same magnitude and opposite polarities, wherein the second voltage and the fourth voltage have a same voltage level; and wherein the third voltage and the fifth voltage have a same voltage level.

10. The driving method of claim 1, wherein the plurality of sustain periods each include a common period for commonly performing a sustain discharge on each group for a given time period.

11. A plasma display device comprising:

a plasma display panel having a plurality of first electrodes and a plurality of second electrodes;

a driving board for applying a driving waveform to the second electrodes such that the plasma display panel displays an image thereon and biasing the first electrodes at a first voltage while the image is being displayed on the plasma display panel; and a chassis base being disposed opposite to the plasma display panel, wherein the driving board performs, in at least one subfield, a grouping of the plurality of second electrodes into a plurality of groups including a first group and a second group, and having a plurality of address periods and a plurality of sustain periods respectively corresponding to the plurality of groups;

selecting turn-on cells among cells of the first group and the second group during the plurality of address periods of the first group and the second group;

generating a sustain discharge on cells of the plurality of groups including at least the first group and the second group by alternately applying a second voltage and a third voltage to the plurality of second electrodes during a first sustain period provided between the address period of the first group and the address period of the second group, wherein the second voltage and the third voltage are respectively higher and lower than the first voltage; and generating a sustain discharge on cells of a plurality of groups including at least the first group and the second group by alternately applying the second voltage and the third voltage to the plurality of second electrodes during a second sustain period provided after the address period of the second group.

12. The plasma display device of claim 11, wherein a last voltage applied during the first sustain period is the third voltage.

13. The plasma display device of claim 12, wherein during the second sustain period, applying a fourth voltage higher than the second voltage and lower than the third voltage to a second electrode of the first group at least once.

14. The plasma display device of claim 13, wherein while the fourth voltage is being applied, the third voltage is applied to a second electrode of the second group.

15. The plasma display device of claim 13, wherein the second voltage and the third voltage are alternately applied to the plurality of second electrodes during the second sustain period, excluding a period during which the fourth voltage is applied.

16. The plasma display device of claim 13, wherein a sustain discharge is not generated in a discharge cell formed by the second electrode of the first group due to the fourth voltage being applied to the second electrode of the first group and a fifth voltage being applied to the second electrode of the first group, subsequent to the fourth voltage.

17. The plasma display device of claim 11, wherein the first voltage is a ground voltage.

18. The plasma display device of claim 11, wherein the second voltage and the third voltage have the same magnitude but opposite polarities.

19. The plasma display device of claim 11, wherein a third sustain period comprises a common period for commonly performing a sustain discharge on each group for a given period of time.

* * * * *

UNITED STATES PATENT AND TRADEMARK OFFICE

CERTIFICATE OF CORRECTION

PATENT NO. : 7,656,367 B2
APPLICATION NO. : 11/258730
DATED : February 2, 2010
INVENTOR(S) : Kazuhiro Ito It is certified that error appears in the above-identified patent and that said Letters Patent is hereby corrected as shown below:

In the Claims

Column 13, Claim 1, line 33 Delete "periods" Insert -- period --

Signed and Sealed this
Twentieth Day of September, 2011

David J. Kappos

David J. Kappos
*Director of the United States Patent and Trademark Office*